US005096071A

United States Patent [19]

Neri

[11] Patent Number: 5,096,071

[45] Date of Patent: Mar. 17, 1992

[54] DEVICE FOR RESTRAINING PAINT CANS ON PAINT CAN STIRRING APPARATUS

[76] Inventor: Giuseppe Neri, Via dei Lavoratori, 128/130, 20092 Cinisello Balsamo, Milan, Italy

[21] Appl. No.: 612,408

[22] Filed: Nov. 13, 1990

[30] Foreign Application Priority Data

Dec. 12, 1989 [IT] Italy ..... 22657 A/89

[51] Int. Cl.[5] ..... A47G 29/00

[52] U.S. Cl. ..... 211/71; 366/605

[58] Field of Search ..... 211/71, 70.1, 73, 86; 248/300, 108; 366/605

[56] References Cited

U.S. PATENT DOCUMENTS

| | | | |
|---|---|---|---|
| 2,753,054 | 7/1956 | Becher | 211/73 |
| 2,802,649 | 8/1957 | Stockton | 211/71 X |
| 3,201,078 | 8/1965 | Grandjean | 248/300 |
| 3,918,234 | 11/1975 | Weissman | 248/300 X |
| 4,789,245 | 12/1988 | Morbeck | 366/605 X |
| 4,893,773 | 1/1990 | Fujimoto | 248/300 X |

*Primary Examiner*—Carl D. Friedman
*Assistant Examiner*—Korie H. Chan
*Attorney, Agent, or Firm*—Bucknam and Archer

[57] ABSTRACT

A device for restraining paint cans to be stirred comprises a restraining plate having an obtuse-angle bent portion including a plurality of adjoining openings each provided for being firmly engaged by a respective cover of paint cans arranged on a stirring table of a paint can stirring apparatus.

2 Claims, 4 Drawing Sheets

DEVICE FOR RESTRAINING PAINT CANS ON PAINT CAN STIRRING APPARATUS

BACKGROUND OF THE INVENTION

The present invention relates to a device for restraining paint cans on paint can stirring apparatus and, in particular, it relates to a device for restraining different-shape-cover paint cans the paint of which is to be stirred.

As is known, paints are usually packaged in paint cans which can be mounted, for stirring, on a stirring apparatus, the paint held in the cans being stirred by a small shaft projecting from the can cover and provided, at the top thereof, with a small fork the arms of which upward extends.

Other known paint can stirring apparatus comprise a plurality of paint can receiving shelves or tables, specifically designed to drive a plurality of paint stirring shafts for stirring the paint of a plurality of paint cans arranged in an adjoining relationship on the apparatus shelf elements.

In this connection it should be pointed out that these paint stirring apparatus must be necessarily provided with paint can restraining members for firmly locking the paint cans during the paint stirring operation.

These restraining elements, in particular, usually comprise cam elements firmly engaging the paint can covers: however, since the height of the paint cans can vary from can to can, conventional paint can stirring apparatus can be exclusively used with paint cans provided with like can covers.

SUMMARY OF THE INVENTION

Accordingly, the main object of the present invention is to overcome the above mentioned drawback by providing a device for restraining or locking paint cans on paint can stirring apparatus suitable for restraining different types of covers.

Another object of the present invention is to provide such a paint can restraining device which can be also easily fitted to different height paint cans.

Another object of the present invention is to provide such a paint can restraining device which can be anchored on the paint can stirring apparatus in a very quick and simple way.

According to one aspect, of the present invention, the above mentioned objects, as well as yet other objects, which will become more apparent thereinafter, are achieved by a device for restraining paint cans on paint can stirring apparatus, comprising a restraining plate having an obtuse-angle bent portion including a plurality of adjoining openings, each provided with a front slanted portion to locate a respective paint can on a shelf element of a paint can stirring apparatus, and a horizontal portion to firmly restrain the cover element of the paint can, means being moreover provided for anchoring the restraining plate to a top portion of a plurality of the shelf elements of the stirring apparatus.

BRIEF DESCRIPTION OF THE DRAWINGS

Further characteristics and advantages of the device according to the present invention will become more apparent from the following detailed description of a preferred, though not exclusive, embodiment thereof, which is illustrated, by way of an indicative but not limitative example, in the figures of the accompanying drawings where.

DESCRIPTION OF THE PREFERRED EMBODIMENTS

Figure 1:
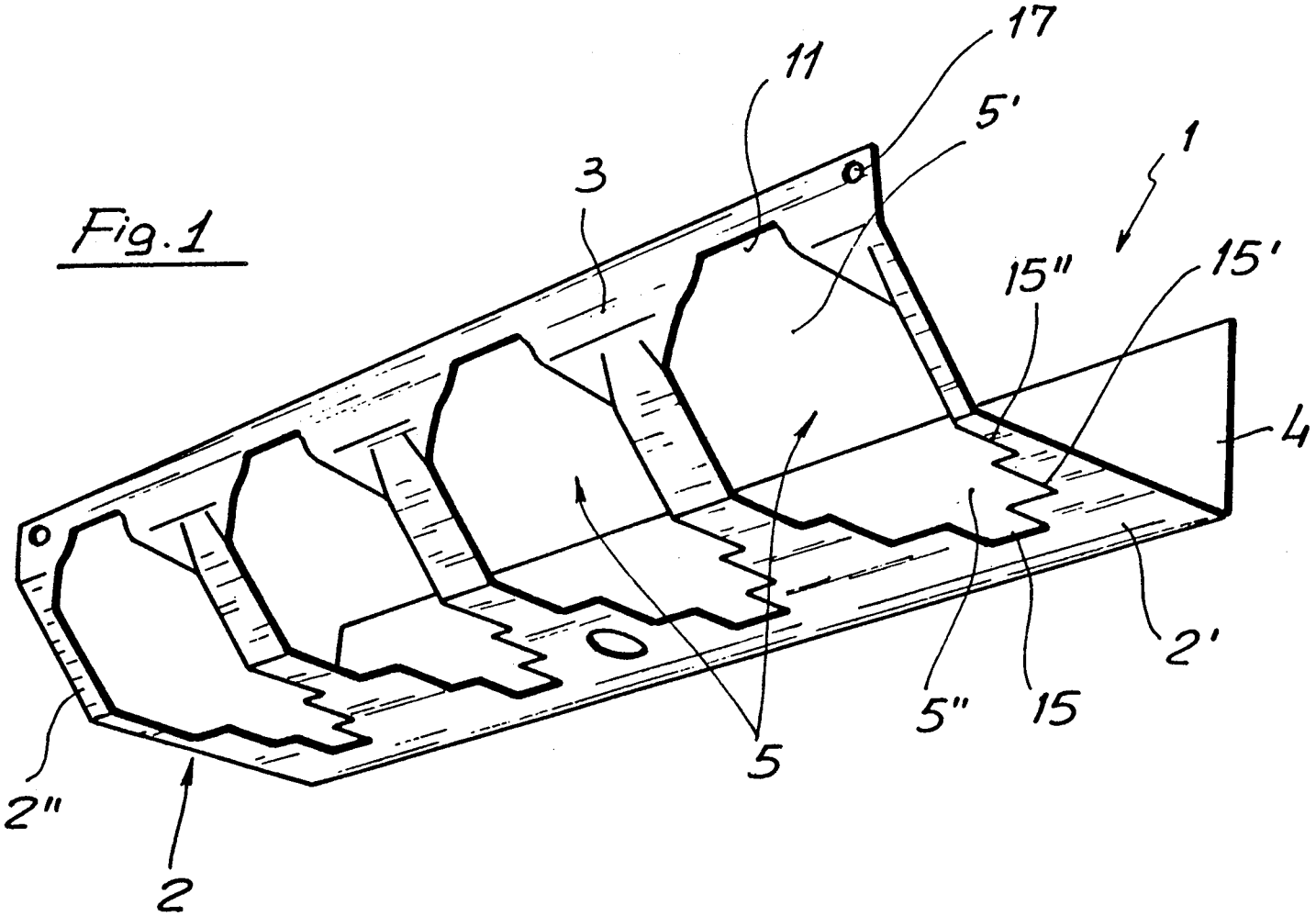
FIG. 1 is a bottom perspective view illustrating the restraining device according to the invention.
Figure 2:
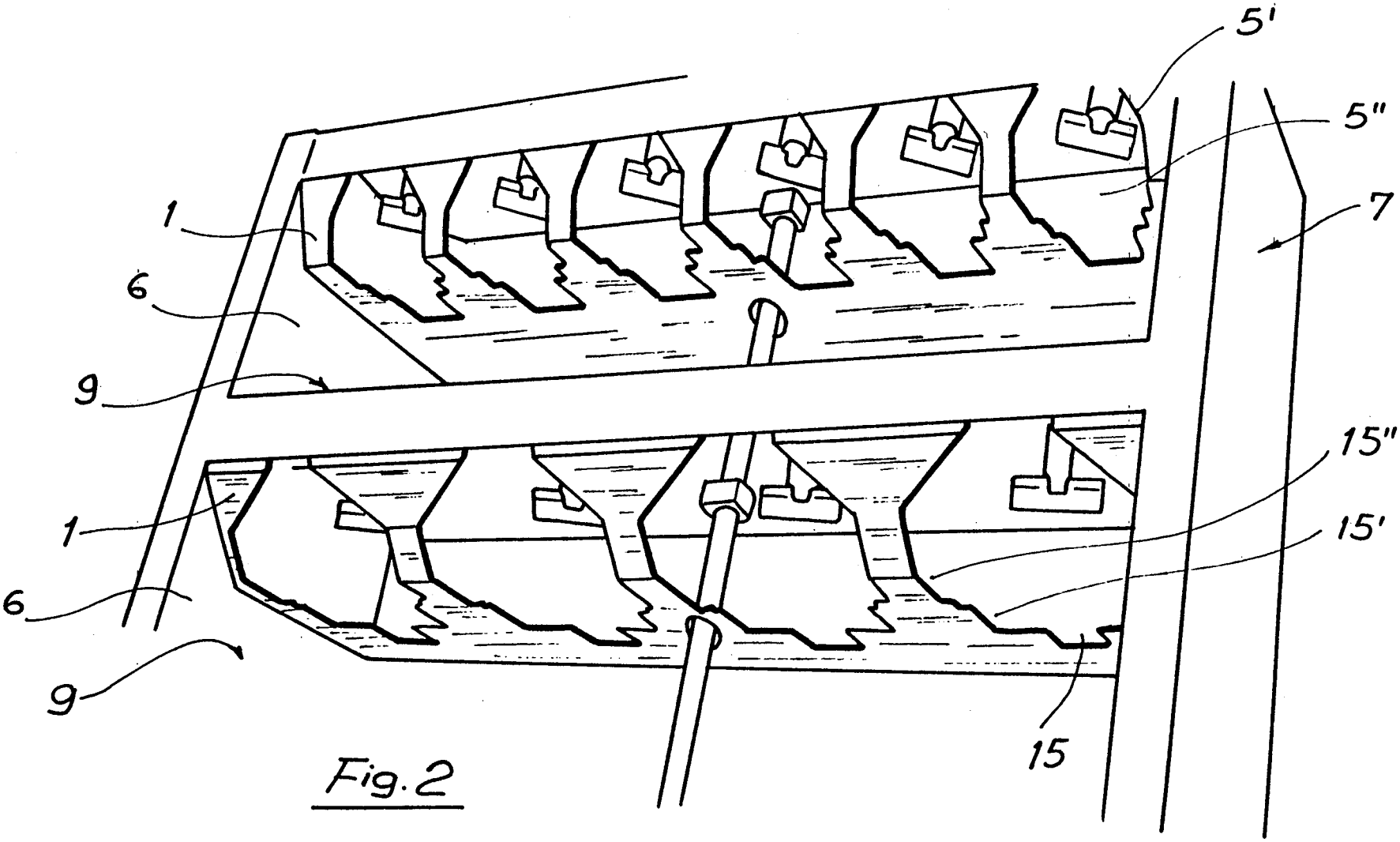
FIG. 2 is a schematic partial view of a paint can stirring apparatus including a plurality of paint can restraining devices according to the invention.
Figure 4:
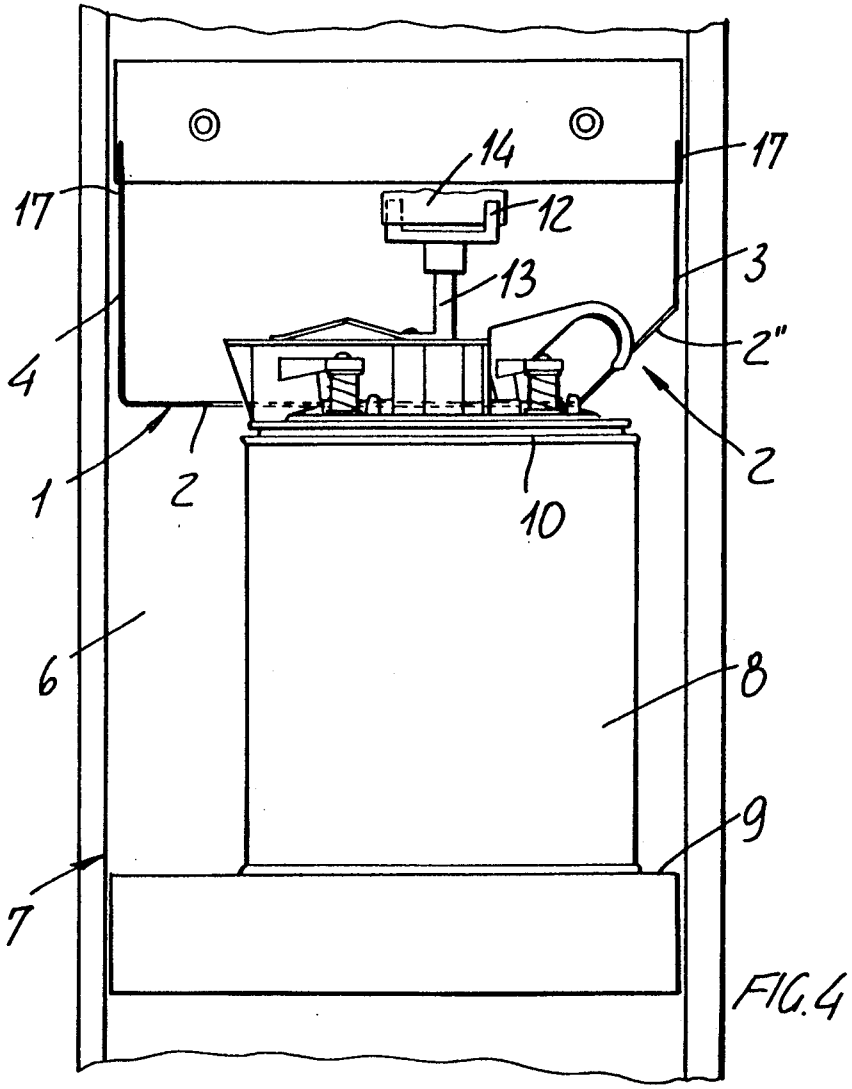
FIGS. 3 and 4 are respectively a front view and a side cross-sectional view showing a possible procedure for restraining a paint can.
Figure 3:
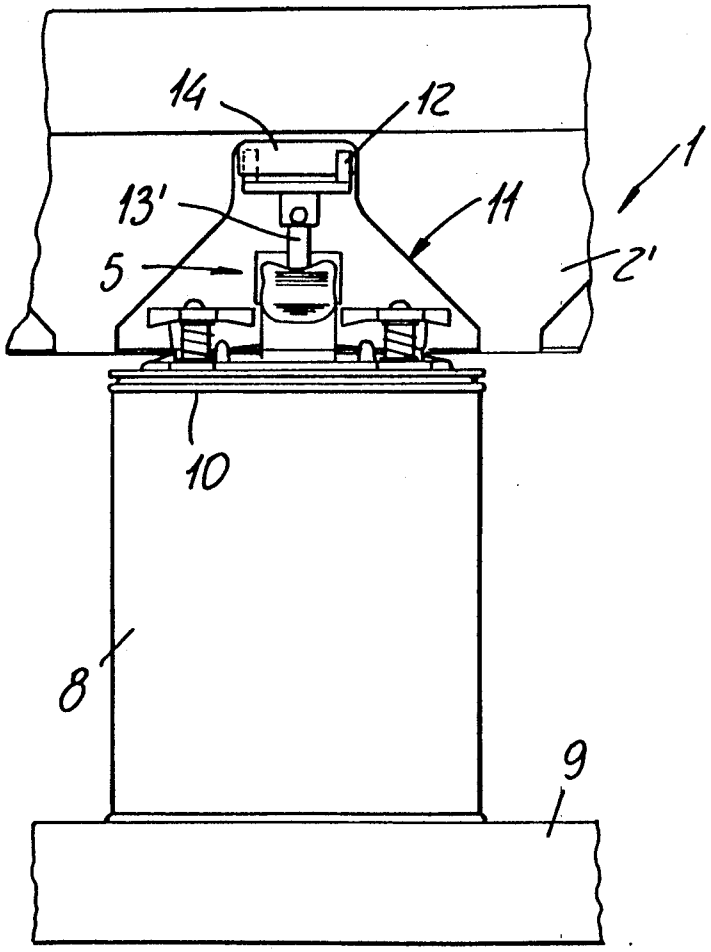
Figure 6:
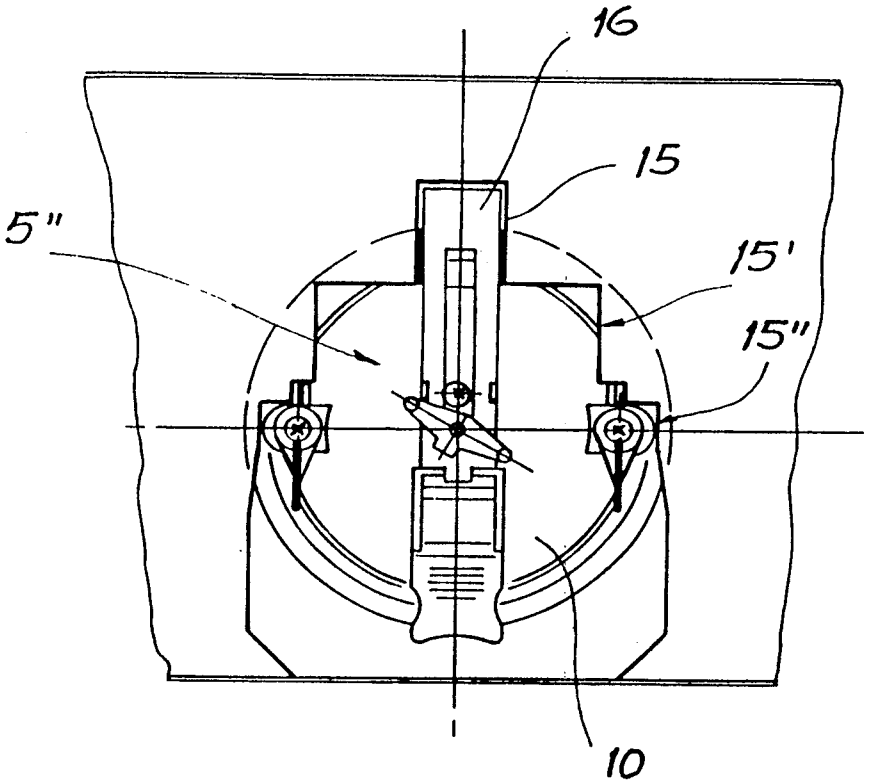
FIGS. 5 and 6 are respective top views showing a possible procedure for locking the covers of paint cans, having, respectively, a four cam cover or a two cam cover.
Figure 5:
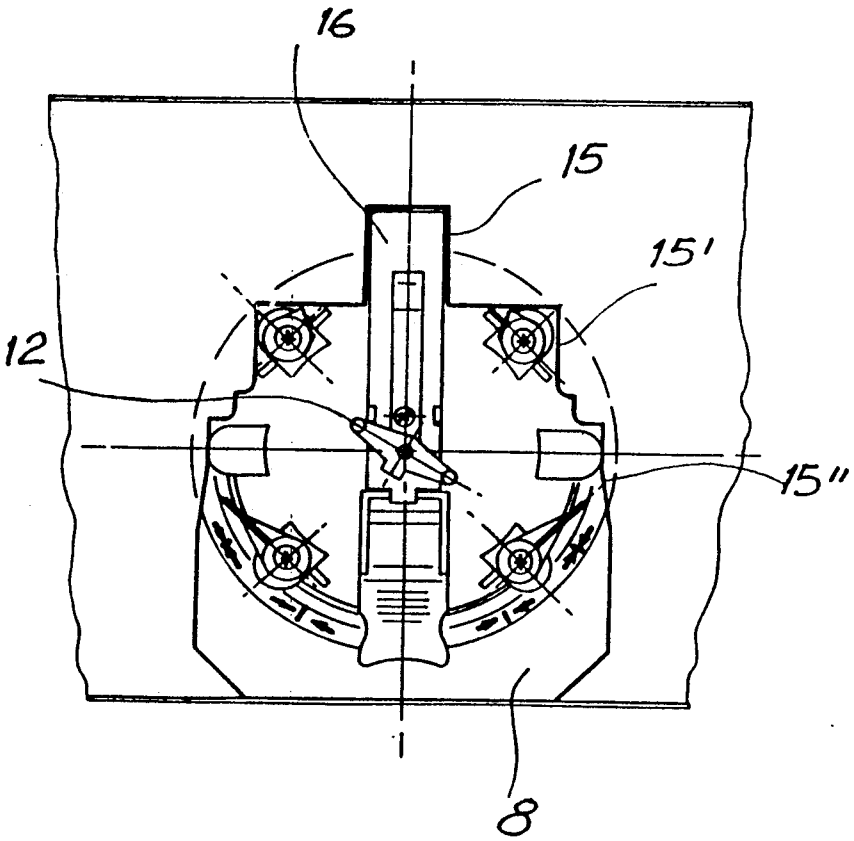

With reference to the figures of the accompanying drawings, the device for restraining paint cans on paint can stirring apparatus according to the present invention essentially comprises a contoured plate, generally indicated at the reference number 1, which is provided with an obtuse-angle bent portion 2 from end parts of which longitudinally upward extend parallel portions 3 and 4 of different heights.

Along the mentioned obtuse-angle portion, there are provided adjoining openings 5 which transversely extend with respect to said obtuse-angle portion and have a specifically designed perimetrical profile.

More specifically, the mentioned upward extending parallel portions 3 and 4 allow the restraining plate 1 to be anchored to the top portions of the compartments 6 of a paint can stirring apparatus 7, the parallel portions being so shaped that a surface 2' of the obtuse-angle portion is arranged horizontally, whilst the other surface 2'' will be arranged at the front of the apparatus with a suitable slanted configuration.

In operation, the slanted front portion 5' of the mentioned openings will allow a paint can 8 to be properly arranged on a shelf element 9 of the stirring apparatus, whereas the horizontal portion 5'' of the same opening will restrain or lock protecting or cam portions formed on the cover 10 of the paint can.

As is shown, the front portion of the mentioned opening has a substantially frustum of cone shaped profile 11, which extends on the front vertical portion of the plate for engaging with a fork element 12 mounted on a shaft 13 and rotatively driven by a driving small plate 14.

The horizontal portion 5'' of that same opening, on the other hand, has a profile which is defined by corresponding broken lines so as to provide, in succession, corresponding rectangular seats indicated respectively at 15, 15' and 15'' and having increasing widths.

In operation, into the smallest seat, closed at the rear thereof, will be introduced a locking element 16 for locking the can cover on the can whereas, against the corner portions of the subsequent seats, will be respectively restrained two of the cam elements of a paint can provided with a four-cam cover, and the two cam elements of a paint can having a two cam cover.

In this connection it should be moreover pointed out that, for the above mentioned inner-most seat, small width variations can be provided, by using suitable spacer elements.

The two vertical portions 3 and 4 of the restraining plate 1, in turn, are provided with a plurality of throughgoing holes 17 so as to allow the restraining plate to be restrained at a set height.

Of course, the number of the openings formed through each plate can vary depending on the width of the opening (which in turn will depend on the width of the paint cans) and the length of the plates (which will depend on the width of the paint can stirring apparatus).

While the invention has been disclosed and illustrated with reference to a preferred embodiment thereof, it should be apparent that the disclosed embodiment is susceptible to several modifications and variations all of which will come within the spirit and scope of the appended claims.

I claim:

1. A paint can stirring apparatus which includes a plurality of compartments and a plurality of paint stirring shafts each having a restraining fork element, paint cans being each provided with a can body and a can cover, each can being located on a shelf element of said paint can stirring apparatus, means for restraining said paint can comprising a restraining plate having an obtuse-angle bent portion including a plurality of adjoining openings and end portions therefrom upwardly extend two different height parallel portions, said openings being each provided with a front slanted portion for locating a respective can on said shelf element of said paint can stirring apparatus, and a horizontal portion for firmly restraining the cover of said paint can, means being moreover provided for anchoring said restraining plate to a top portion of a plurality of said shelf elements of said stirring apparatus, said upwardly extending parallel portions restraining said plate at top portions of said plurality of compartments of said stirring apparatus, said front slanted portion of each of said openings having a substantially frustum of cone shaped profile extending on a front vertical portion of said plate and fitting one of said fork elements, said horizontal portion of each of said openings having a profile defining a plurality of adjoining substantially rectangular seats having a width outwardly increasing, so as to restrain both can covers having a two cam out-line and can covers having a four cam outline.

2. A restraining device according to claim 1, wherein said plate comprises a plurality of throughgoing holes for restraining said plate at a set level.

* * * * *